US007108425B2

(12) United States Patent
Temkin

(10) Patent No.: US 7,108,425 B2
(45) Date of Patent: Sep. 19, 2006

(54) FOAM INSERTS FOR HANDBAGS

(76) Inventor: Elizabeth Temkin, 400 E. 68th St., New York, NY (US) 10022

( * ) Notice: Subject to any disclaimer, the term of this patent is extended or adjusted under 35 U.S.C. 154(b) by 189 days.

(21) Appl. No.: 10/397,756

(22) Filed: Mar. 26, 2003

(65) Prior Publication Data

US 2004/0187987 A1 Sep. 30, 2004

(51) Int. Cl.
*A45C 13/02* (2006.01)

(52) U.S. Cl. ..... 383/127; 383/33; 150/106; 150/900; 190/106

(58) Field of Classification Search ..... 150/104–106, 150/900, 111, 113, 127; 190/106; 383/33, 383/127

See application file for complete search history.

(56) References Cited

U.S. PATENT DOCUMENTS 1,927,471 A * 9/1933 Salomon ..... 190/1
3,323,151 A * 6/1967 Lerman ..... 5/722
3,763,509 A * 10/1973 Mittendorf ..... 5/640
3,938,569 A * 2/1976 Hill ..... 150/110
3,944,033 A * 3/1976 Simson ..... 190/117
4,116,310 A * 9/1978 Shields ..... 224/576
4,185,673 A * 1/1980 Daniello ..... 383/14
4,277,859 A * 7/1981 Seaman ..... 5/639
4,907,633 A * 3/1990 Eckstein ..... 150/105
4,966,279 A * 10/1990 Pearcy ..... 206/315.11
5,030,014 A * 7/1991 Diamond et al. ..... 383/127
5,119,519 A * 6/1992 Foreman ..... 5/640
5,138,728 A * 8/1992 Aston ..... 5/645
5,299,335 A * 4/1994 Ivester et al. ..... 5/641
5,450,958 A * 9/1995 Shin ..... 206/315.6
5,458,164 A * 10/1995 Tawil ..... 141/10
5,911,262 A * 6/1999 Steinhart ..... 150/103
5,918,332 A * 7/1999 Dees ..... 5/639
5,934,808 A * 8/1999 Ozeri et al. ..... 383/127
6,360,388 B1 * 3/2002 Langer ..... 5/632
6,430,764 B1 * 8/2002 Peters ..... 5/641
6,769,807 B1 * 8/2004 Bayard ..... 383/127

FOREIGN PATENT DOCUMENTS

KR 2001017063 A * 3/2001

* cited by examiner

*Primary Examiner*—Sue A. Weaver
(74) *Attorney, Agent, or Firm*—Darby & Darby

(57) ABSTRACT

A shaped resilient foam insert and a method of maintaining a shape and reducing wrinkling and creasing of a handbag during storage are provided. The method includes opening the handbag to expose an interior cavity thereof which is formed by walls of the handbag. The interior cavity has a first set of dimensions and the shaped resilient foam body (insert) is disposed within the interior cavity. The foam body has a second set of dimensions with at least one dimension of the second set being greater than one dimension of the first set so that the foam body applies an outward force against walls of the handbag so that the handbag maintains its shape during storage and the walls are supported during storage so as to help prevent wrinkling and creasing of the handbag.

34 Claims, 7 Drawing Sheets

FIG. 8
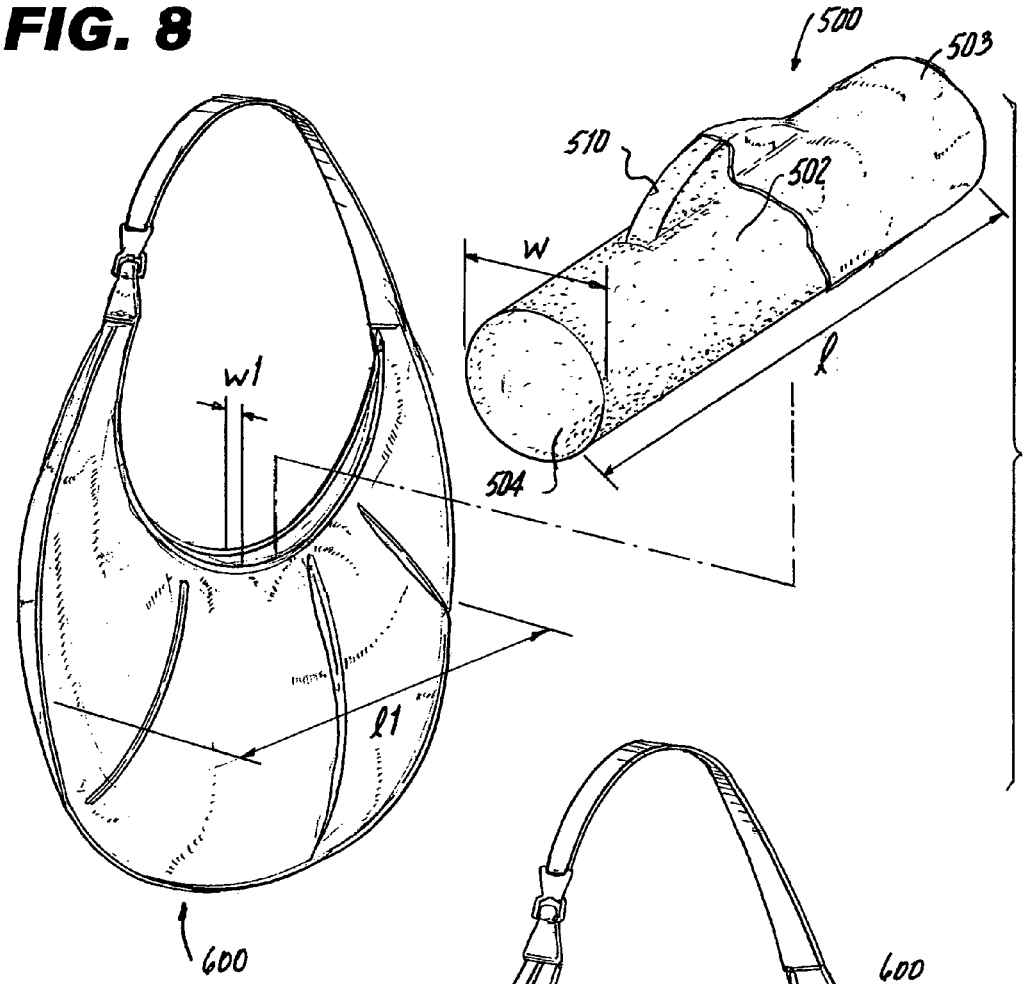
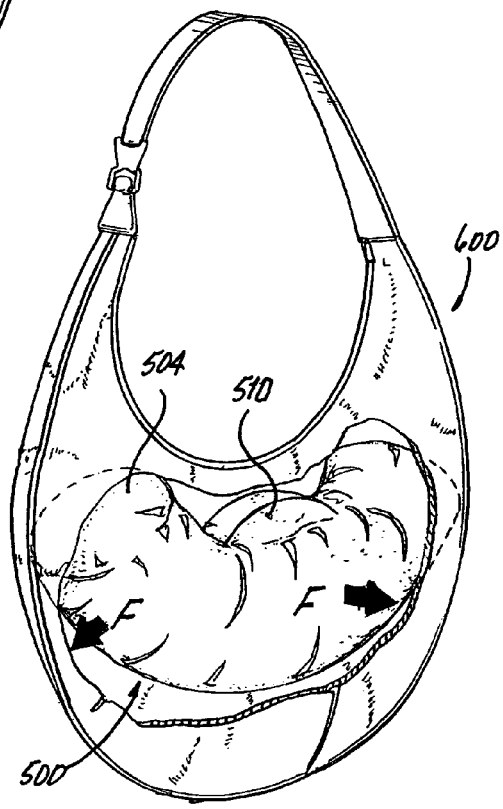
FIG. 9

FOAM INSERTS FOR HANDBAGS

TECHNICAL FIELD

The present invention relates generally to handbags, and more particularly to an insert that is intended to be placed within an interior of the handbag when it is not being used to maintain the shape and extend the life of the handbag.

BACKGROUND

As is well known, one of the more important accessories for a woman is a handbag since it is not only a functional item but also at the same time makes a fashion statement. The number of handbags available to the consumer is ever increasing since most fashion houses have their own line of handbags and there are a number of companies that specialize or focus on the manufacture of handbags. Also, designer handbags are increasingly more and more coveted by consumers as they have increasingly become more of a status symbol and define the current fashion trends.

It is therefore common for a woman to have a number of handbags in her collection since many of the handbags are intended for specific types of functions or uses. For example, most women have one or more everyday handbags that are carried to and from work and typically are sized to carry an agenda or the like as well as cosmetic products, a cell phone, etc. For more formal events or evening plans, a smaller, more formal style handbag is typically used. In addition, handbags are available in a great number of different shapes and sizes and moreover, handbags can be made from a number of different types of materials, such as exotic skins (alligator, etc.), suede, fabrics, smooth leather, textured leather, etc.

Because many of the designer handbags are not inexpensive to purchase and many women have a number of different handbags and are continuously looking to update their collection as fashion trends change each year, the purchase of handbags is a significant investment for the average woman from year to year. At the stores, the handbags that are in stock are typically stuffed with tissue paper or some other type of paper product so that the handbag maintains its shape as it remains in stock until it is purchased. Once the purchaser returns home with the handbag, the tissue paper is most times discarded as trash. In the event that the purchaser does keep the tissue paper within the interior of the handbag to provide structural support and help in maintaining the shape of the handbag, it is likely that over time such use of tissue paper will either be terminated or it will not serve its intended purpose. If the owner does continuously remove the tissue paper and then replace it after using the handbag, the continuous handling of the tissue paper tends to cause it to become compacted and also ripped into little pieces. The structural rigidity of the tissue paper is thus compromised and as the tissue paper loses its resiliency, it is no longer capable of acting as a stuffing that substantially occupies the interior of the handbag so that the shape of the handbag is maintained. Also, as the tissue paper rips into smaller pieces, it becomes messy and the owner is likely to completely discard all of the stuffing.

If handbags are stored for long periods of time without any support member disposed in the interior thereof, they begin to lose their shape or form since the walls of the handbag are not supported. In addition, the handbag is more apt to wrinkle or develop creases as a result of the lack of support. This is especially true for handbags that are not used that often. In other words, an evening or formal handbag that is only used at select times throughout the year, is therefore stored for long periods of time in a typically upright position and over time, the handbag begins to lose its shape. Not only does this type of storage make the handbag lose some of its aesthetic appeal but it also can decrease the life of the handbag.

It is therefore desirable to provide a member that is intended to extend the life of the handbag by being used within the handbag when it is being stored between uses.

SUMMARY

A shaped resilient foam insert and a method of maintaining a shape and reducing wrinkling and creasing of a handbag during storage are provided. The method includes opening the handbag to expose an interior cavity thereof which is formed by walls of the handbag. The interior cavity has a first set of dimensions and the shaped resilient foam body (insert) is disposed within the interior cavity. The foam body has a second set of dimensions with at least one dimension of the second set being greater than one dimension of the first set so that the foam body applies an outward force against walls of the handbag so that the handbag maintains its shape during storage and the walls are supported during storage so as to help prevent wrinkling and creasing of the handbag.

Further aspects and features of the exemplary apparatus disclosed herein can be appreciated from the appended Figures and accompanying written description.

BRIEF DESCRIPTION OF THE DRAWINGS

The invention will be more fully understood by reference to the following drawings which are for illustrative purposes only:

FIG. 8 is a perspective view of an insert according to another embodiment and including an integral handle and being exploded from an alternative styled handbag;

FIG. 9 is a perspective view of the insert of FIG. 8 disposed within the handbag of FIG. 8, shown partially broken away, in a storage position;

DETAILED DESCRIPTION OF THE PREFERRED EMBODIMENTS

Figure 1:
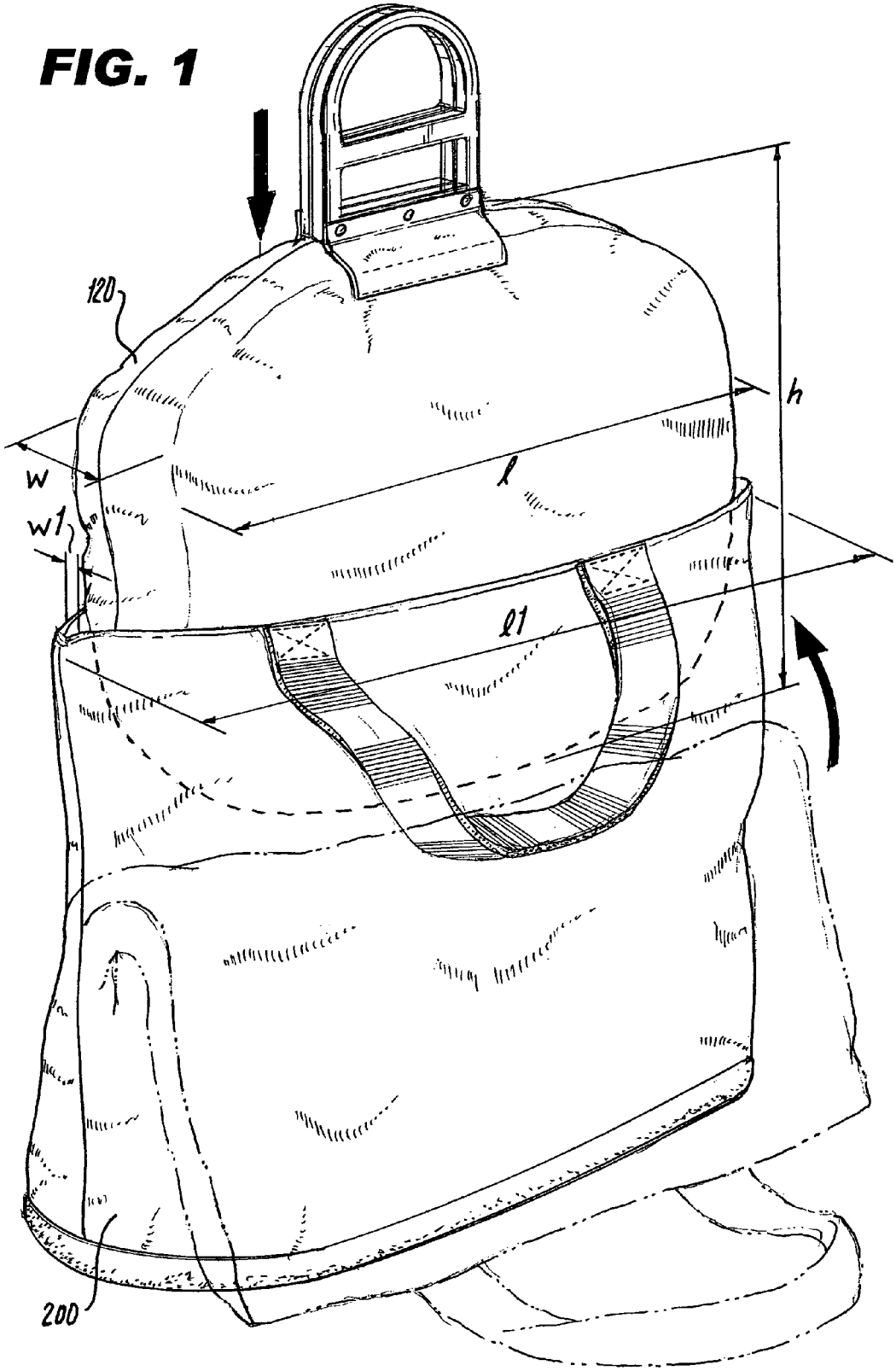
FIG. 1 is a perspective view of an insert for a handbag according to a first embodiment with the handbag being shown in phantom in a relaxed position before insertion and in an upright position.
Figure 2:
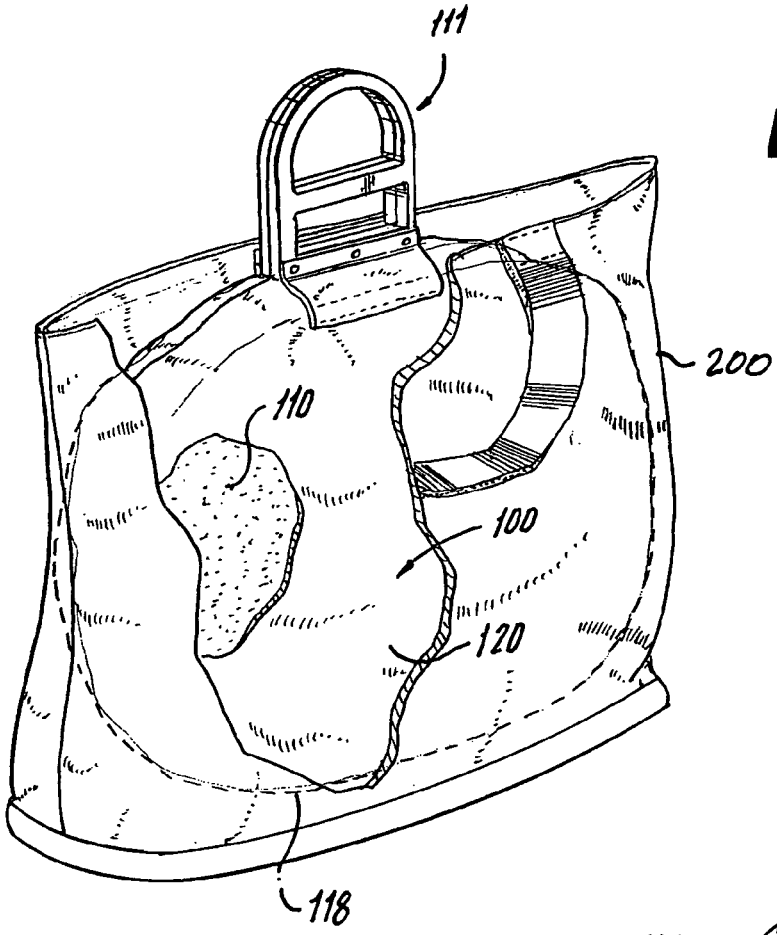
FIG. 2 is a perspective view of the insert of FIG. 1 disposed within the handbag, shown partially broken away along with the insert, to illustrate a storage position.
Figure 3:
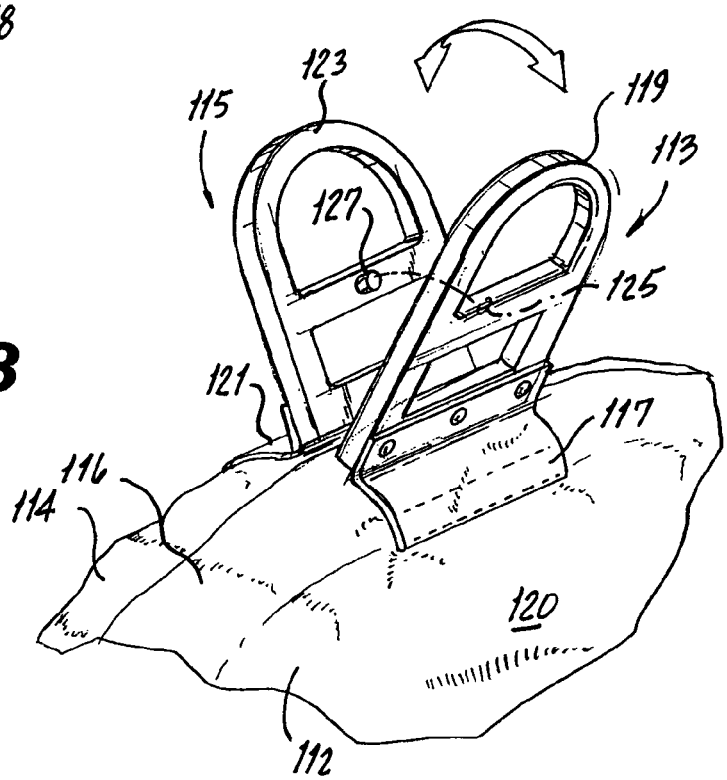
FIG. 3 is an enlarged perspective view of a handle section of the insert of FIG. 1 with the handle being in an open position.

Referring first to FIGS. 1–3, an insert 100 for placement within an interior of a handbag 200 is provided and generally illustrated. In one exemplary embodiment, the insert 100 is in the form of a foam pillow that has a predetermined shape. The exemplary insert 100 includes a body 110 that is formed in to the predetermined shape. The body 110 has a length L, a width W and a height H and the illustrated insert 100 has a first face 112 and an opposing second face 114. The body 110 is made of a preformed material that allows the body 110 to define and maintain a three-dimensional shape. Preferably, the body 110 is made of a resilient material that conforms to the interior contours of the handbag 200 when the insert 100 is inserted into the interior cavity of the handbag 200 and returns to its original shape after use. In one preferred embodiment, the body 110 is made of a resilient closed cell foam (memory foam); however, the body 110 can be formed of other materials, such as plastic foams, foam rubbers or other materials that are suitable for the intended application.

In the illustrated embodiment, the first and second faces 112, 114 are joined at the ends thereof and a third face 116 is defined along the top of the insert 100 where the first and second faces 112,114 are joined and the third face 116 generally acts as an upper face when the insert 100 is positioned within the interior cavity of the handbag 200. A fourth face 118 is formed opposite the third face 116 and acts as a bottom face of the insert 100. When the insert 100 of this embodiment is disposed within the interior cavity of the handbag 200, the first face 112 faces one side of the handbag 200 and the second face 114 faces the opposite side of the handbag 200. The third face 116 generally faces the open portion of the handbag 200 that serves as an entrance to the interior cavity.

The insert 100 includes a covering 120 that completely surrounds the body 110. The covering 120 can be formed of a number of individual panels that are securely attached to one another as by stitching or otherwise attaching the edges of adjacent panels together so as to capture the body 110 within the covering 120. The covering 120 is preferably formed of a fabric, such as cotton, silk or other type of fabric and it will be appreciated that the covering 120 can have a decorative pattern formed thereon. Also, the covering 120 can come in a number of different colors. It will further be appreciated that the surfaces of the covering 120 provide an area where advertisements can be placed or the corporate trademark of the handbag manufacturer can be placed thereon. Of course, the decorative pattern can be a simple plaid pattern or it can cater to the individual tastes of the consumer.

It will be appreciated that it is not necessary for the insert 100 to have an identical shape or even closely similar shape as the handbag 200 since the resiliency of the foam material that is used to form the insert 100 permits the insert 100 to be locally compressed by the user's hands so as to permit the insert 100 to be inserted into the interior cavity of the handbag 200. Once positioned within the interior cavity and the user removes the applied pressure to the insert 100, the memory properties of the foam material cause the insert 100 to attempt to assume its initial relaxed position. In other words, the insert 100 will attempt to expand within the handbag 200. This expansion applies pressure against the walls of the handbag 200 and it will be appreciated that the insert 100 should occupy a significant area of the interior cavity in the stored position. Because the foam body 110 is in intimate contact with the walls of the handbag 200 and applies pressure thereof, these walls are prevented from sagging or otherwise collapsing over time as the handbag 200 is stored. In other words, the insert 100 serves to help the handbag 200 maintain an optimum shape and as a result, the insert 100 helps prevent wrinkles or creases from forming in the handbag 200 due to it being stored for a significant amount of time in a position where the walls are not in their upright or optimal positions. Preferably, in the stored position, the insert 100 occupies at least 50% and more preferably at least 75% of the area of the interior cavity of the handbag 200.

For example, FIG. 1 illustrates handbag 200 in a collapsed form (shown in phantom) which results due to a lack of structural support of the handbag 200, which in this case is a tote style bag. This type of bag 200 is susceptible to having its walls fold over because of the height and lack of structure to the bag 200. The bag 200 is therefore likely to crease and also it occupies an excessive storage space since it can not remain upright on its own.

Thus, the insert 100 can have one shape and it will still perform its intended function with a number of different shaped handbags 200 even though the shapes of the insert 100 and the handbag 200 are not identical or bear a strong resemblance to one another. For example, the exemplary shaped insert 100 can be used not only with handbags 200 that are generally rectangular or square shaped but also circular shaped, oval shaped or any number of other shapes so long as the insert 100 occupies a sufficient amount of area within the interior cavity and applies a sufficient force against the interior walls of the handbag 200. More specifically, as long as either both ends or the outer surface is in intimate contact with the interior walls of the handbag 200, the insert 100 will apply a force thereagainst that is sufficient to cause the handbag 200 to maintain its shape. It will be appreciated that in some applications, the insert 100 does not necessarily have to extend the entire length of the handbag 200 but rather the width of the body 110 is such that the outer surfaces of the side faces are in intimate contact with the interior side walls of the handbag 200 and applies a shape retaining force to the handbag 200 so that the walls are maintained in their optimum upright positions.

At least one and preferably two or more dimensions of the insert 100 are greater than the dimensions of the handbag 200 so that the insert needs to be compressed in order to be received within the interior cavity of the handbag 200. The compressing and resilient nature of the insert 100 causes it to store energy and then once the insert 100 is placed into the interior cavity and the user removes the applied force to the insert, the insert 100 releases its energy and attempts to resume its initial, relaxed state; however, the walls of the handbag 200 prevent this from occurring. This results in the insert 100 applying a force against the walls in an outward direction relative to the interior cavity of the handbag 200, thus causing the handbag 200 to maintain a condition where its interior cavity is significantly and preferably substantially filled by the insert. Thus as shown in FIG. 1, in one embodiment, the width (W) of the insert 100 is greater than the width ($W_1$) of the interior cavity of the handbag 200.

FIG. 2 illustrates the insert 100 in a position within the handbag 200 with the handbag 200 being partially broken away to illustrate the insert 100 disposed within the interior of the handbag 200. In addition, the insert 100 is shown partially broken away so that the foam of the insert 100 is shown. As illustrated, the insert 100 occupies a significant amount of the interior space of the handbag 200; however, the insert 100 can occupy less space of the interior and still be effective. In other words, the insert 100 can occupy about 50% of the interior space and still properly function.

The insert 100 can include a handle 111 that is formed at the upper face 116. As shown in FIG. 3, the handle 111 includes a first handle part 113 and a second handle part 115 that cooperate and mate with one another to form the handle 111. The first handle part 113 includes a base portion 117 that is securely connected to one of the first and second faces 112, 114 and a rigid handle portion 119 that is securely attached to the base portion 117. Similarly, the second handle part 115 includes a base portion 121 that is securely connected to the other of the first and second faces 112, 114 and a rigid handle portion 123 that is securely attached to the base portion 121. For example, the base portions 117, 121 can be formed of a fabric material to permit pivoting of the respective rigid handle portions 119, 123. In other words, the rigid handle portions 119, 123 are fully pivotable between open and closed positions in which in the open position, the rigid handle portions 119, 123 can lie next to the respective face of the insert 100. Each of the rigid handle portions 119, 123 can be formed of a plastic material and includes a fastening feature to permit the two portions to mate and securely be coupled to one another. For example, the rigid handle portion 119 can include a first fastener part 125 (e.g., a female part) and the rigid handle portion 123 can include a complementary fastener part 127 (e.g., a male part).

To form the handle 111, the first handle part 113 and the second handle part 115 mate with one another to form a unitary, upright structure that permits a user to easily grasp the insert 100 and remove it from the handbag 200. While, the first and second fastener parts 125, 127 are shown as rigid, plastic members, they can also be other fasteners, such as a hook and loop arrangement and snap fit buttons or magnetic. Preferably, the first and second fastener parts 125, 127 are releasable from one another.

Figure 4:
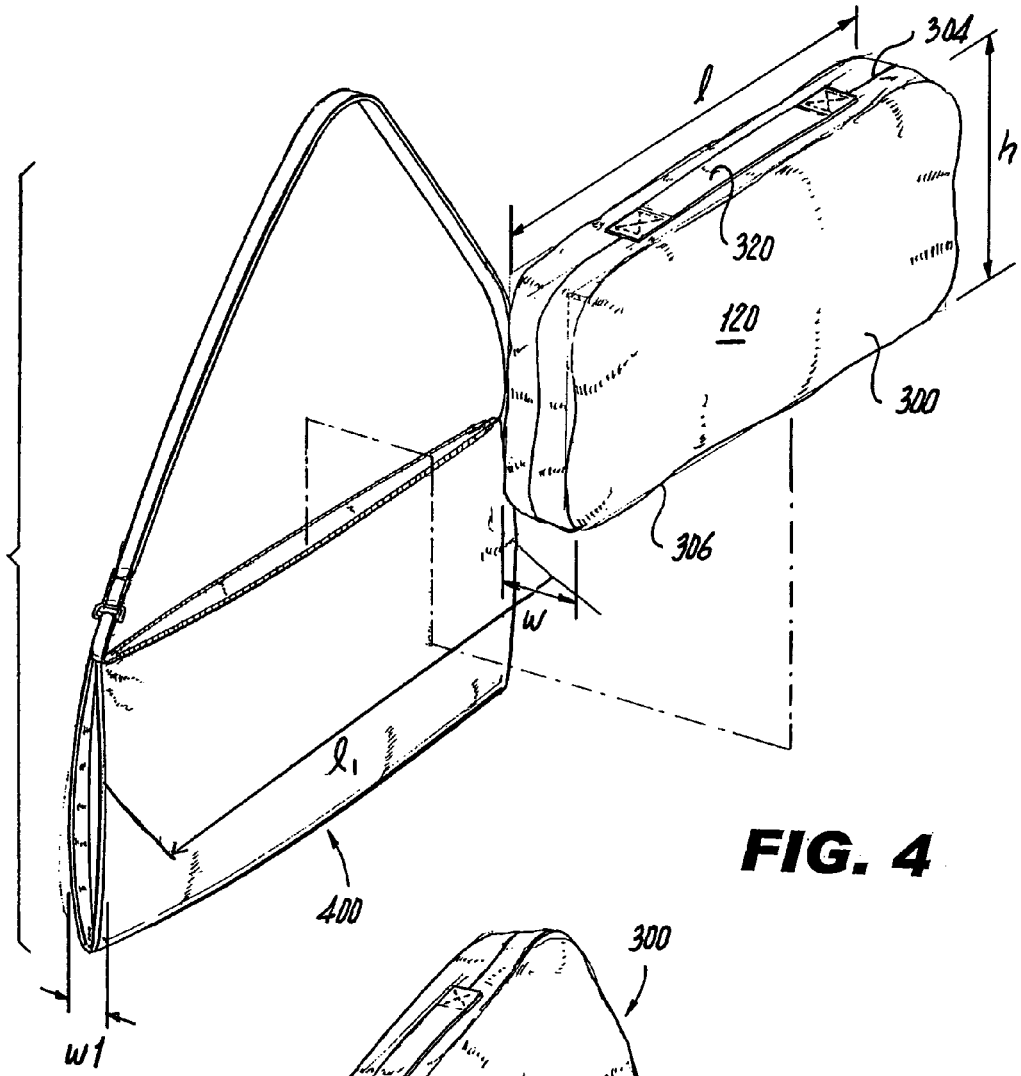
FIG. 4 is an exploded perspective view of an insert according to a second embodiment prior to insertion into a handbag of another embodiment.
Figure 5:
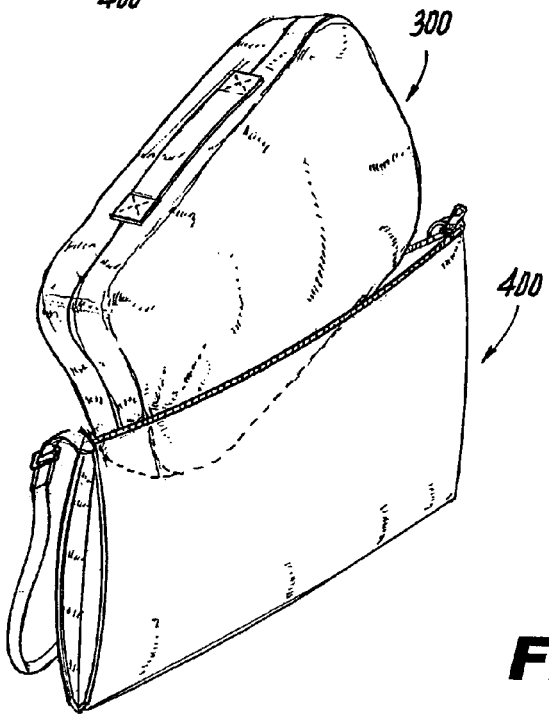
FIG. 5 is a perspective view of the insert of FIG. 4 being inserted into the handbag.
Figure 6:
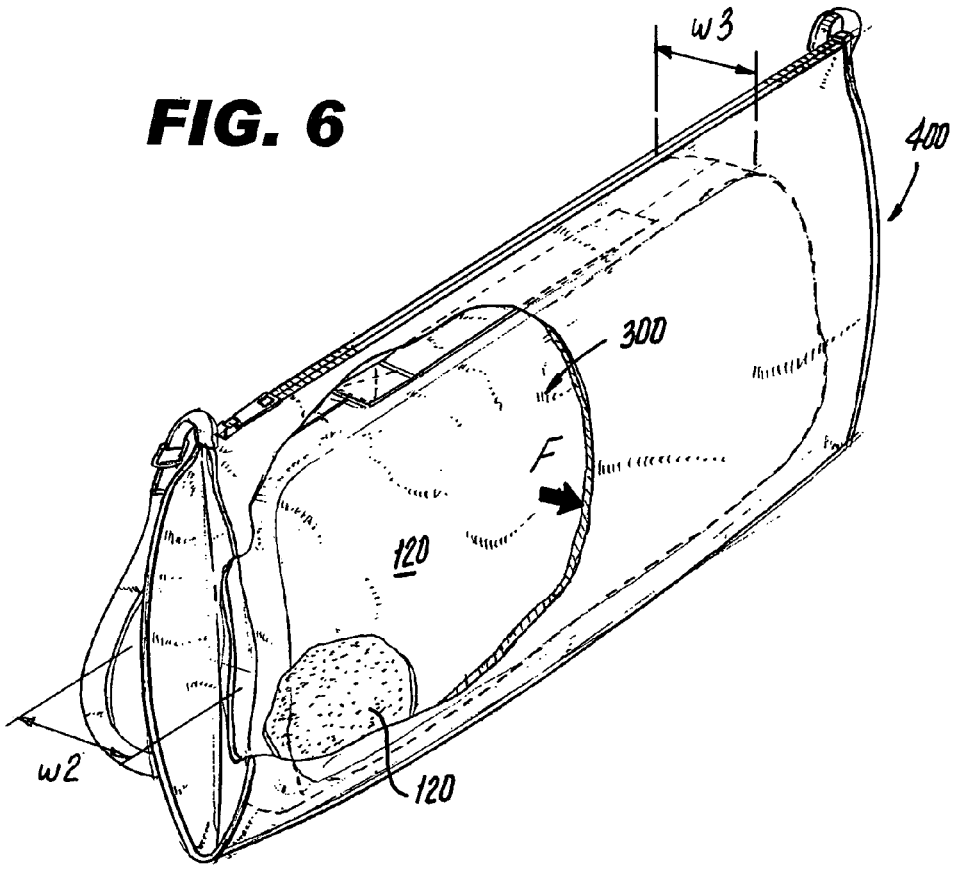
FIG. 6 is a perspective view of the insert of FIG. 4 disposed within the handbag, shown partially broken away along with the insert, to illustrate a storage position.

FIGS. 4–6 illustrate another embodiment in which an insert 300 is inserted into a handbag 400 to ensure that the handbag maintains its proper shape during storage thereof. The insert 300 is similar to the insert 100 with the exception that the insert 300 is of a different shape. The insert 300 is generally of a rectangular shape with rounded edges.

In this embodiment, the insert 300 includes a handle 320 that is formed of a fabric material and is attached to an upper face 304 of the insert 300. More specifically, the handle 320 can be attached at its ends to the covering 120. While, the handle 320 is shown on the upper face 304, another one can be disposed at the opposite bottom face 306 so that it does not matter which way the insert 300 is inserted into the handbag.

In all of their embodiments, the one or more handles serves to facilitate the removal of the insert from the handbag. The user can therefore grasp the one or more handles and pull the insert thereby from the handbag. Also, the handle can serve as a locating feature since the insert should be placed within the interior cavity such that the handle is facing the open top portion of the handbag.

FIG. 4 shows the insert 300 exploded from the handbag 400. FIG. 5 shows the handbag 400 with the insert 300 being partially disposed therein. FIG. 6 shows the insert 300 being disposed within the handbag 400, which is closed. A section of a side wall of the handbag 400 is cut away to permit viewing of the insert 300 and a section of the insert 300 is likewise partially cut away to show the foam body underneath the cover material. The length (L) of the insert 300 is greater than the length ($L_1$) of the handbag 400 according to this embodiment. In addition, the insert 300 was a width (W) that is greater than a width ($W_1$) of the handbag 400 (($W_3$) is the width of the insert 300 after placed in the handbag 400, while width ($W_2$) shows the expanded width of the handbag 400.

Figure 7:
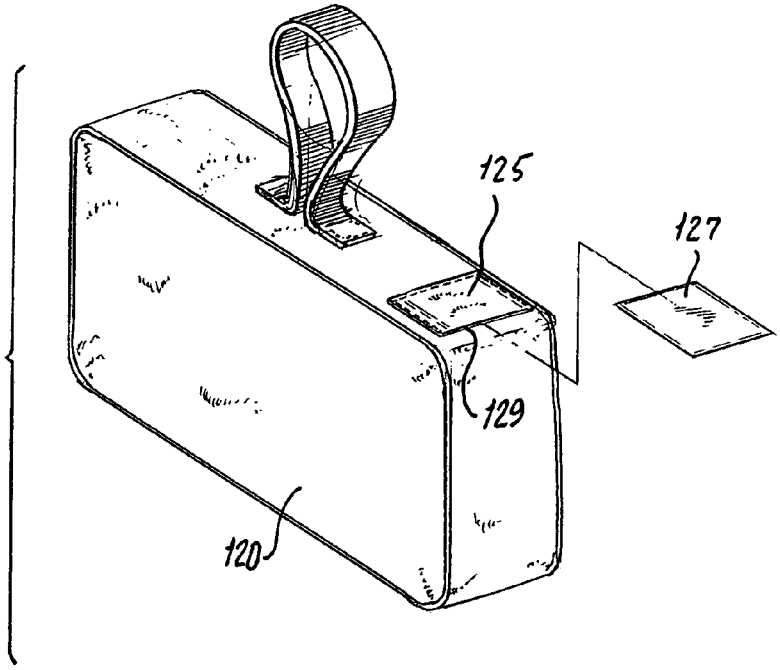
FIG. 7 is a perspective view of an insert according to a third embodiment with a fragrance feature being incorporated therein and a fragrance element being exploded therefrom.

It yet another aspect, the insert can have a feature formed as a part thereof that stores a disposable and replaceable fresh smelling element. More specifically and as illustrated in FIG. 7, the covering 120 includes a pouch 125 or the like that contains and stores the element 127 that is preferably a disposable packet or perforated bag that contains material that emits a fresh smell over an extended period of time. The precise fragrance can be selected by the consumer based on personal preference and taste since the elements 127 are preferably disposable and easily replaceable. The fragrance can be a flowery smell or it can be a pine smell, potpourri, citrus flavor, etc. The pouch 125 consists of fabric that is attached to the covering 120 and has an entrance 129 formed as part thereof to permit reception and removal of the element 127. The element 127 itself preferably has a complementary shape as the pouch 125 and it is fully contained within the pouch 125 when it is stored therein. In other words, the element 127 can be a thin, rectangular member that is placed within the pouch 125. The pouch 125 can be located on any of the faces of the insert; however, for the most effective dispersement of fragrance, the element 127 should not be immediately next to a wall of the handbag but rather slightly spaced therefrom.

Figure 12:
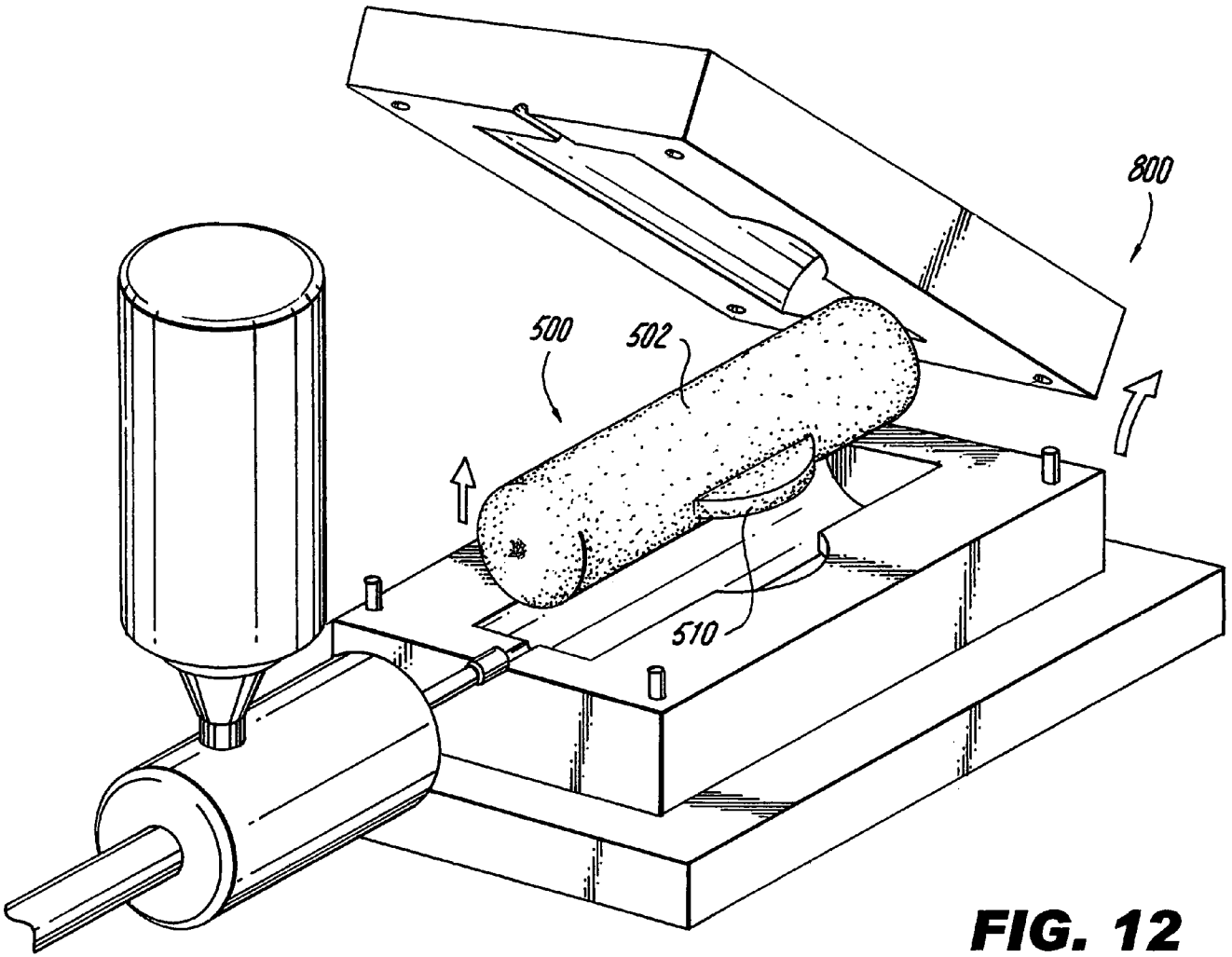
FIG. 12 is a perspective view of a mold used to form the insert of FIG. 8.

FIGS. 8 and 9 illustrate an insert 500 of yet another embodiment. In this embodiment, the insert 500 has a foam body 502 that is generally cylindrical in shape and includes opposing end faces 504. The insert 500 preferably includes a covering 503, which is similar or identical to the covering 120. FIG. 8 shows the insert 500 exploded from a handbag 600 and FIG. 9 shows the insert 500 inserted into the handbag 600. In this embodiment, one or more integral handles 510 are formed as part of the body 502. In other words, the one or more handles 510 are formed of the same foam material that forms the body 502. Such construction can be achieved using a common mold 800 (FIG. 12) in which the polymeric material used to form the closed cell foam body is disposed into the mold 800, which includes a contoured section for forming the one or more handles 510. After the mold process is completed, the material is permitted to cool and the resultant article includes the body 502 and the integral one or more handles 510 with the entire structure being formed as a single unit. The one or more handles 510 can have a number of different shapes in and of themselves and can be attached to the body 502 at any one of the faces thereof and not necessarily at an edge where two faces intersect. More specifically, the handle 510 can be U-shaped or more arcuate in shape (e.g., semi-circular or loop-like in shape) or it can have another suitable shape. In one exemplary embodiment and as illustrated in FIG. 2, the handle 510 is attached to the body 502 along one face thereof instead of at an intersection between two faces. More specifically, the insert 500 of FIG. 8 shows the handle 510 being centrally located along an outer cylindrical surface 506 of the body 502. When there is more than one handle 500 (e.g., two handles), the handles 500 are preferably spaced apart from one another.

When the insert includes the covering 120, the one or more handles are formed of a fabric that can be the same fabric as the covering 120 or it can be a different fabric. In either instance, the fabric handle is securely attached to the fabric covering using conventional techniques, such as stitching or the like.

One will appreciate that the handbag can come in any number of different shapes and sizes. For example, the handbag can have a circular shape, oval shape, square shape, or any number of irregular shapes. FIGS. 1–9 illustrate other exemplary handbag shapes and it will be appreciated that a number of different sized and shaped inserts can be used for these handbags.

Figure 10:
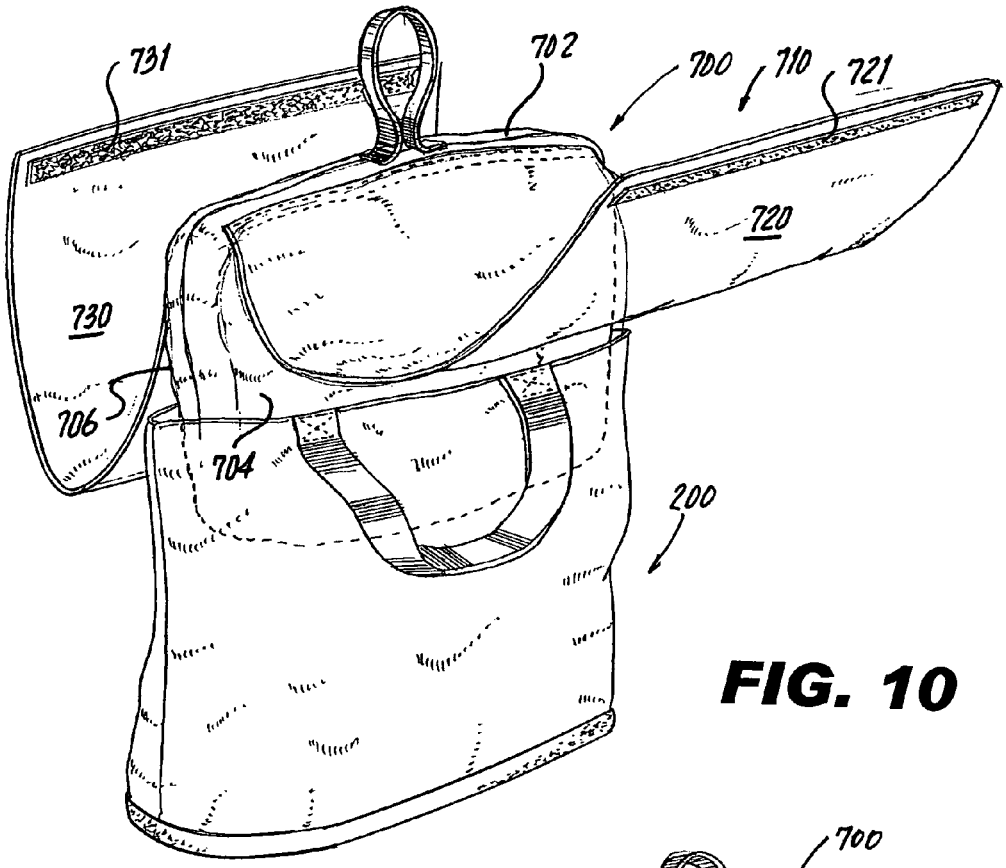
FIG. 10 is a perspective view of an insert according to another embodiment with a pair of protective coverings being formed as a part thereof, the insert shown partially inserted into a handbag.
Figure 11:
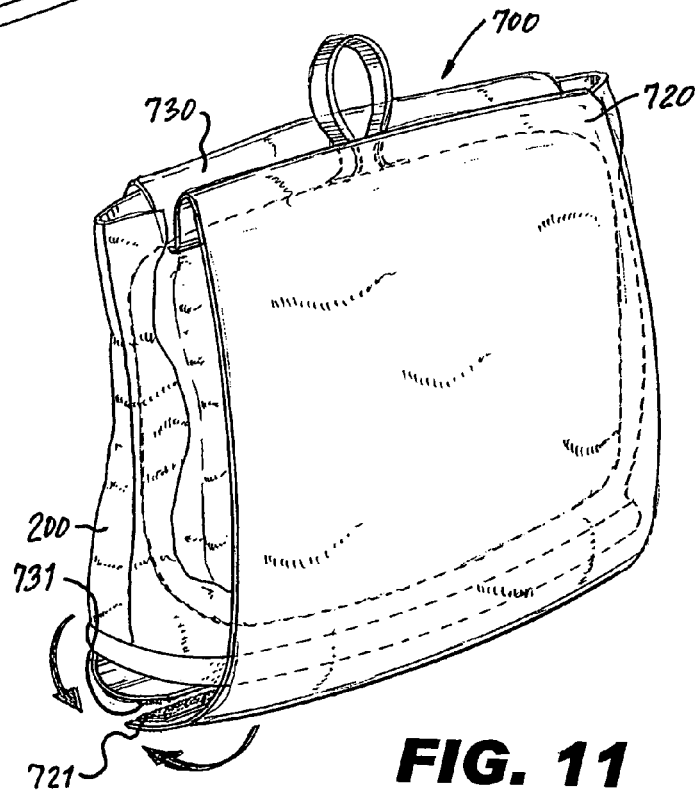
FIG. 11 is perspective view of the insert of FIG. 10 fully inserted into the handbag with the protective coverings draped over sides of the handbag.

FIG. 10–11 illustrate yet another embodiment where an insert 700 is used with the handbag 200 of FIG. 1. The insert 700 is similar to insert 100 with the exception that it includes a protective cover feature 710 for protecting the outer side walls of the handbag 200. As best shown in FIG. 10, the insert 700 has a first side cover 720 that is securely attached near the upper face 702 thereof and drapes down over a first side face 704. A second side cover 730 is securely attached near the upper face 702 and drapes down over a second side face 706. The side covers 720, 720 are preferably fabric member or sheets of plastic that are secured to the insert 700 by traditional means, such as stitching, tacking, or use of an adhesive. The height of the side covers 720, 730 is greater than the height of the insert 700 and therefore when the side covers 720, 730 are folded down and lie against the insert 700, the side covers 720, 730 extend below the insert 700 a predetermined distance.

FIG. 11 illustrates the insert 700 disposed within the handbag 200. In this embodiment, the side covers 720, 730 drape down over respective side walls of the handbag 200 so as to protect these side walls. In other words, the side covers 720, 730 are not inserted into the interior of the handbag 200 but rather the side covers 720, 730 are disposed on an exterior of the handbag 200. One side cover covers the exterior of the side wall of the handbag 200 and the other side cover covers the exterior of the other side wall. By covering the side wall of the handbag, the side wall is protected from dust and other foreign matter that may collect and spoil the exterior of the side walls. In addition, if the handbag 200 is arranged next to other handbags, the side covers 720, 730 protect the handbag 200 from contact with the other handbags. Rubbing or inadvertent contact between adjacent handbags can lead to scuffing and other blemishes.

The side covers 720, 730 also include a fastening feature to releasably couple the side covers 720, 730 to one another. For example, the side cover 720 can include a first fastening element 721 and the side cover 730 can include a second fastening element 731. In one embodiment, the first and second fastening elements 721, 731 are a hook and look type fastening structure. However, it can be also snap and fit buttons, etc.

While this invention has been particularly shown and described with references to preferred embodiments thereof, it will be understood by those skilled in the art that various changes in form and details may be made therein without departing from the scope of the invention encompassed by the appended claims.

What is claimed is:

1. An insert for reception in an interior cavity of a handbag for maintaining a natural shape of the handbag when it is stored, the insert comprising:

a foam body having a prescribed shape;

at least one handle integrally formed as part of the foam body in a common mold, the handle being formed of the same foam material as the foam body and located along a continuous section of the foam body removed from any intersecting edges of the foam body;

a pouch that is associated with the foam body, the pouch having an entrance; and a fragrant element disposed within the pouch.

2. The insert of claim 1, wherein the foam body has a cylindrical shape defined by a continuous cylindrical outer surface and opposing end faces, the at least one handle being formed along the cylindrical outer surface.

3. The insert of claim 1, wherein the foam body is formed of a closed cell foam material.

4. The insert of claim 1, wherein the foam body has a shape selected from the group consisting of cylindrical, rectangular, square, oval, and oblong.

5. The insert of claim 1, wherein the at least one handle is one of U-shaped and arcuate shaped.

6. The insert of claim 1, wherein the foam body is constructed so that a length thereof is greater than a length of the interior cavity.

7. The insert of claim 1, wherein the foam body is constructed so that a width thereof is greater than a width of the interior cavity.

8. The insert of claim 1, where there are two handles that are spaced apart from one another.

9. An insert for reception in an interior cavity of a handbag for maintaining a natural shape of the handbag when it is stored, the insert comprising:

a foam body having a prescribed shape and a first set of dimensions, wherein the handbag has a second set of dimensions, at least one dimension of the first set being greater than one dimension of the second set so that the foam body applies an outward force against walls of the handbag so that the handbag maintains its shape during storage and the walls are supported during storage so as to help prevent wrinkling and creasing of the handbag, the foam body being freely removable from the handbag, the insert including a first protective cover attached along an upper section of a first side of the body and a second protective cover attached along an upper section of a second side of the body, each of the first and second protective covers having a free end which extends beyond a bottom of the insert for draping over one side wall of the handbag for protection thereof.

10. The insert of claim 9, wherein the first and second protective covers are fabric sheets that are stitched to the insert along the upper sections of respective first and second sides thereof, each of the first and second fabric sheets has a height that is greater than a height of the handbag so that the fabric sheets drape down over the respective first and second sides.

11. The insert of claim 9, wherein the first protective cover includes a first fastening element proximate the free end thereof and the second protective cover includes a second fastening element proximate the free end thereof.

12. The insert of claim 11, wherein the first and second fastening elements comprise hook and loop type fasteners.

13. A combination handbag and insert for reception in an interior cavity of a handbag for maintaining a natural shape of the handbag when it is stored, the insert comprising:

a foam body having a prescribed shape and a first set of dimensions, wherein the handbag has a second set of dimensions, at least one dimension of the first set being greater than one dimension of the second set so that the foam body applies an outward force against walls of the handbag so that the handbag maintains its shape during storage and the walls are supported during storage so as to help prevent wrinkling and creasing of the handbag, the foam body being freely removable from the handbag, wherein the insert includes a pouch that is formed along an outer surface of the insert and is open at one end to the exterior for receiving a fragrant element that is slidably received and withdrawn from the pouch to permit different fragrant elements to be interchanged for one another.

14. The combination of claim 13, wherein the foam body has a cylindrical shape defined by a continuous cylindrical outer surface and opposing end faces.

15. The combination of claim 13, further including:

at least one handle integrally formed as part of the foam body in a common mold, the handle being formed of the same foam material as the foam body and located along a continuous section of the foam body removed from any intersecting edges of the foam body.

16. The combination of claim 13, wherein the foam body is formed of a closed cell foam material.

17. The combination of claim 13, wherein the foam body has a shape selected from the group consisting of cylindrical, rectangular, square, oval, and oblong.

18. The combination of claim 13, wherein the foam body is constructed so that a length thereof is greater than a length of the interior cavity.

19. The combination of claim 13, wherein the foam body is constructed so that a width thereof is greater than a width of the interior cavity.

20. The combination of claim 13, further including:

a covering disposed over the foam body, wherein edges of the covering are securely attached to one another so as encapture the foam body within the covering which is formed of a fabric material.

21. The combination of claim 13, wherein the body includes a handle having a first rigid part that is securely attached to the body at one location and a second rigid part that is securely attached to another location spaced from the one location, the first and second rigid parts being pivotable in open positions and having complementary fastening features that releasably mate with one another to form a unitary handle member.

22. The combination of claim 21, wherein the fastening features comprise a female part formed as part of the first rigid part and a male part that is formed as part of the second rigid part.

23. The combination of claim 21, wherein the first and second rigid parts are formed of plastic and are securely attached to the body by fabric strips that are attached to the body.

24. A method of maintaining a shape and reducing wrinkling and creasing of a handbag during storage, the method comprising the steps of:

opening the handbag to expose an interior cavity thereof which is defined by walls of the handbag, the interior cavity having a first set of dimensions;

inserting a shaped resilient body having a foam portion into the interior cavity, the body having a second set of dimensions, at least one dimension of the first set being greater than one dimension of the second set so that the body applies an outward force against walls of the handbag so that the handbag maintains its shape during storage and the walls are supported during storage so as to help prevent wrinkling and creasing of the handbag;

forming a pouch along an outer surface of the body, the pouch being open along one edge thereof to the exterior of the body; and slidably disposing a fragrant element into the pouch such that the fragrant element can be easily removed to permit different fragrant elements to be interchanged for one another so as to vary or refresh the fragrance.

25. The method of claim 24, wherein the resilient body is formed of a closed cell foam material.

26. The method of claim 24, wherein the resilient body has a shape selected from the group consisting of cylindrical, spherical, rectangular, square, oval, triangular and oblong.

27. The method of claim 24, further including the step of:

forming one or more handles as part of the body.

28. The method of claim 27, wherein the one or more handles are integrally formed with the body in a common mold, the one or more handles being formed of the same foam material as the foam body.

29. The method of claim 24, further including the step of:

disposing a covering over the body, wherein edges of the covering are securely attached to one another so as encapture the body within the covering.

30. The method of claim 29, wherein the covering is formed of a fabric material.

31. The method of claim 24, further including the step of:

constructing the body so that a length thereof is greater than a length of the interior cavity.

32. The method of claim 24, further including the step of:

constructing the body so that a width thereof is greater than a width of the interior cavity.

33. The method of claim 27, wherein the body has a cylindrical shape defined by a cylindrical outer surface and two end faces and at least one handle is formed along the cylindrical outer surface.

34. The method of claim 28, wherein the handle is formed along a continuous face of the body removed from a location where two faces of the body intersect.

* * * * *